United States Patent [19]

Adachi et al.

[11] 4,442,791

[45] Apr. 17, 1984

[54] ADHESIVE COMPOUND COATING APPARATUS

[75] Inventors: Masami Adachi, Higashimurayama; Hirato Shimasaki, Tokyo; Isao Nomizu, Kaminokawa; Taketo Matsuzaki, Akigawa, all of Japan

[73] Assignee: Bridgestone Tire Company Limited, Tokyo, Japan

[21] Appl. No.: 479,132

[22] Filed: Mar. 25, 1983

[30] Foreign Application Priority Data

May 13, 1982 [JP] Japan ..... 57-80992

[51] Int. Cl.[3] ..... B05C 1/16

[52] U.S. Cl. ..... 118/669; 118/679; 118/682; 118/240; 118/241; 118/243; 118/247; 118/248; 118/258; 118/263; 118/211; 118/703; 427/284; 427/208

[58] Field of Search ..... 118/669, 672, 673, 679, 118/681, 682, 687, 241, 242, 255, 263, 248, 258, 240, 243, 247, 244, 706, 211; 427/284, 208, 428

[56] References Cited

U.S. PATENT DOCUMENTS

| | | | |
|---|---|---|---|
| 3,593,308 | 7/1971 | Fagan | 118/679 |
| 3,688,735 | 9/1972 | Brenner | 118/681 |
| 4,173,198 | 11/1979 | Allen | 118/326 |
| 4,389,971 | 6/1983 | Schmidt | 118/669 |

*Primary Examiner*—Shrive P. Beck
*Assistant Examiner*—Robert J. Steinberger, Jr.
*Attorney, Agent, or Firm*—Cushman, Darby & Cushman

[57] ABSTRACT

An adhesive compound coating apparatus for coating an adhesive compound on leading and trailing beveled end faces of a rubber strip material, comprising: a conveyor unit for conveying the strip material in its longitudinal direction; a coating roller disposed to have a center axis substantially perpendicular to the longitudinal direction of the strip material and rotatable about its center axis with respect to the conveyor unit, the coating roller being movable with respect to the conveyor unit between a first position having the center axis of the coating roller positioned below the upper surface of the conveyor unit and a second position having the peripheral surface of the coating roller positioned above the upper surface of the conveyor unit; a drive unit for driving the coating roller to rotate about its center axis; an adhesive compound supplying unit for supplying and applying the adhesive compound on the peripheral surface of the coating roller; a detecting unit operative to detect the positions of the strip material conveyed by the conveyor unit and produce output signals; and a control unit responsive to the output signals delivered from the detecting unit and operative to move the coating roller between the first and second positions.

4 Claims, 6 Drawing Figures

ADHESIVE COMPOUND COATING APPARATUS

FIELD OF THE INVENTION

The present invention relates to an adhesive compound coating apparatus and, in particular, to an apparatus for coating an adhesive compound on leading and trailing beveled end faces of a rubber strip material such as for example a tread rubber material used in an automotive vehicle tire.

SUMMARY OF THE INVENTION

In accordance with the present invention, there is provided an adhesive compound coating apparatus for coating an adhesive compound on leading and trailing beveled end faces of a rubber strip material, the leading and trailing beveled end faces being bias-cut in parallel with each other with respect to the upper and lower surfaces of the rubber strip material, comprising: conveyor means for conveying the rubber strip material in its longitudinal direction; a coating roller disposed to have a center axis substantially perpendicular to the longitudinal direction of the rubber strip material and rotatable about its center axis with respect to the conveyor means, the coating roller being movable with respect to the conveyor means between a first position having the center axis of the coating roller positioned below the upper surface of the conveyor means and a second position having the peripheral surface of the coating roller positioned above the upper surface of the conveyor means; drive means for driving the coating roller to rotate about its center axis; adhesive compound supplying means for supplying and applying the adhesive compound on the peripheral surface of the coating roller; detecting means operative to detect the positions of the rubber strip material conveyed by the conveyor means and produce output signals; and control means responsive to the output signals delivered from the detecting means and operative to move the coating roller toward the second position from the first position when the leading beveled end face of the rubber strip material is advanced to the coating roller so that the leading beveled end face of the rubber strip material is brought into contact with the peripheral surface of the coating roller and is coated with the adhesive compound by the coating roller, and operative to move the coating roller toward the first position from the second position when the trailing beveled end face of the rubber strip material is advanced to the coating roller so that the trailing beveled end face of the rubber strip material is brought into contact with the peripheral surface of the coating roller and is coated with the adhesive compound by the coating roller.

BRIEF DESCRIPTION OF THE DRAWINGS

Advantages of the adhesive compound coating apparatus according to the present invention will be clearly understood from the following description taken in conjunction with the accompanying drawings in which.

PRIOR ART OF THE INVENTION

In general, an endless rubber strip material having a certain cross-sectional contour is extruded by an extruder and is then severed into a predetermined length for an elongated tire tread rubber to be supplied to a tire building drum in a tire production process. The elongated tire tread rubber is then encircled around a green case already built on the tire building drum and is subsequently spliced together at its longitudinal end faces to form an endless tire tread. In order to firmly splice together the longitudinal end faces of the elongated tire tread rubber, an adhesive compound produced by dissolving a rubber material in a certain organic solvent is required to be coated or applied to the longitudinal end faces of the elongated tire tread rubber.

A representative known adhesive compound coating apparatus is disclosed by Japanese laid-open publication No. 54-83080. The coating apparatus herein taught is equipped with a spraying device for spraying an adhesive compound to the longitudinal end faces of the tire tread rubber. Difficulties were however encountered in that the adhesive compound was at all times sprayed on the longitudinal end faces of the tread rubber material to be spliced together under an acceptable spraying condition by the reason that the longitudinal end faces of the tire tread rubber material are coated with the adhesive compound by the spraying device. The reason is such that such an acceptable spraying condition caused by the spraying device at all times requires a constant rubber concentration in the adhesive compound to be supplied to the spraying device. However, such a rubber concentration in the adhesive compound could not be maintained at a constant value and was thus varied for the reason that the adhesive compound is of rubber dissolved in an organic solvent which volatilizes as time lapses. This required a concentration control for the adhesive compound as long as a spraying device was employed in a prior art adhesive compound coating apparatus. Moreover, another difficulty was encountered in that the adhesive compound tends to be solidified like a spider net in the vicinity of the spraying device and therefore results in contamination of environment around the spraying device.

The present invention contemplates elimination of these and other drawbacks which have thus far been inherent in the prior-art adhesive compound coating apparatus of the natures hereinbefore.

DESCRIPTION OF THE EMBODIMENT

Figure 1:
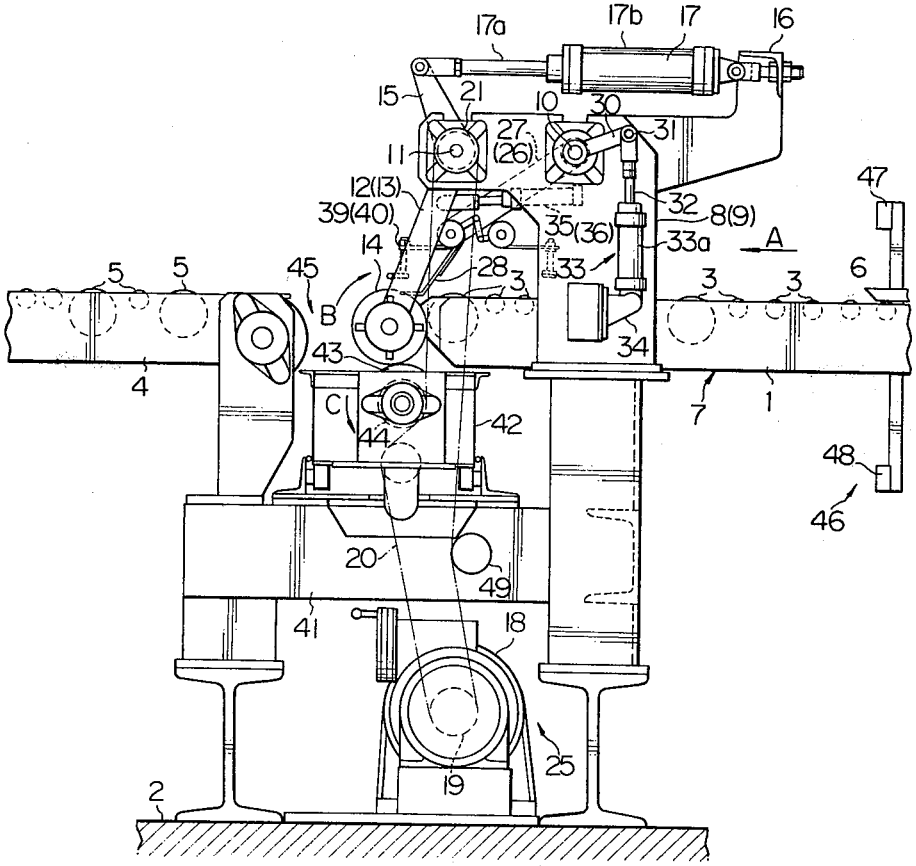
FIG. 1 is a fragmentary side elevational view of the adhesive compound coating apparatus according to the present invention.
Figure 2:
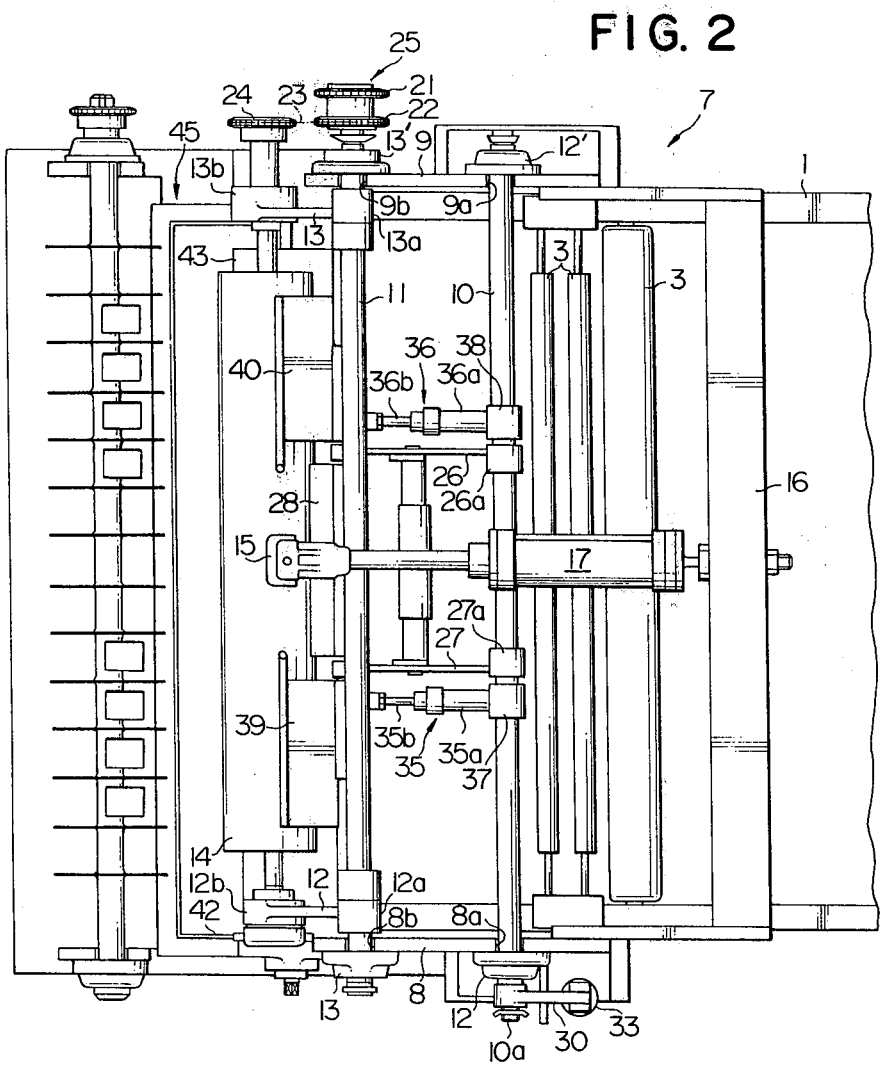
FIG. 2 is a fragmentary plan view of the adhesive compound coating apparatus according to the present invention.

Referring first to FIGS. 1 and 2 of the drawings, the adhesive compound coating apparatus embodying the present invention is shown as comprising a first frame structure 1 securely installed on a floor 2 and having rotatably carried thereon a plurality of first guide rollers 3 extending transversely with respect to the frame structure 1 and spaced apart from and in parallel with one another. The adhesive compound coating apparatus further comprises a second frame structure 4 securely installed on the floor 2 and having rotatably carried thereon a plurality of second guide rollers 5 extending transversely with respect to the frame structure 4 and spaced apart from and in parallel with one another. The second guide rollers 5 are positioned at a level substantially equal to that of the first guide rollers 3. The first and second guide rollers 3 and 5 on the first and second frame structures 1 and 4, respectively, are driven to rotate by an electric motor through a power transmitting assembly in a known manner and to convey a rubber strip material 6 in its longitudinal direction shown in an arrow A of FIG. 1. The first and second frame structures 1 and 4 and the guide rollers 3 and 5 constitute as a whole conveyor means 7 for conveying the rubber strip material 6 in its longitudinal direction. On the downstream end portion of the first frame structure 1 are securely mounted a pair of upstanding post members 8 and 9 of a generally inverted L-shape which project upwardly from the first frame structure 1. The upstanding post members 8 and 9 have upper intermediate recesses 8*a* and 9*a* having rotatably carried thereon the axial end portions of a front shaft 10 through bearings 12 and 12' secured to the upstanding post members 8 and 9, and upper rear recesses 8*b* and 9*b* having rotatably carried thereon the axial end portions of a rear shaft 11 through bearings 13 and 13' secured to the upstanding post members 8 and 9, the shafts 10 and 11 being spaced apart from and in parallel with each other. A pair of rockable arms 12 and 13 are transversely spaced apart from and in parallel with each other along the rear shaft 11 and respectively have at their rear end portions boss portions 12*a* and 13*a* connected to the longitudinal end portions of the rear shaft 11 and at their front end portions boss portions 12*b* and 13*b* securely supporting the opposite longitudinal end portions of a coating roller 14 extending between the arms 12 and 13 and having a center axis held in parallel with the center axis of the rear shaft 11. The coating roller 14 has an outer peripheral surface which is constructed of a cellular sponge capable of absorbing an adhesive compound, and has a center axis substantially perpendicular to the longitudinal direction of the strip material and rotatable about its center axis with respect to the conveyor means 7. To the longitudinally intermediate portion of the rear shaft 11 is fixedly coupled one end portion of a rockable arm 15 which has in turn the other end portion connected to the leading end portion of a piston rod 17*a* forming part of a fluid cylinder 17. The fluid cylinder 17 has a cylinder body 17*b* which is connected at its rear end portion to a cylinder support member 16 which is in turn securely fastened to the bracket members 8 and 9. The fluid cylinder 17 includes front and rear chambers which are held in communication with a suitable fluid source through a change-over valve not shown. The change-over valve is adapted to be changed by control means which will be described hereinafter in such a manner as to allow high pressure fluid to selectively be introduced into the front and rear chambers of the fluid cylinder 17. When the fluid cylinder 17 is actuated to cause its piston rod 17*a* to project forwardly and rearwardly by means of the control means, the rockable arms 2, 13 and 15 are concurrently rocked about the rear shaft 11. The coating roller 14 is thus rockable about the rear shaft 11 with respect to the conveyor means 7 between a first position (I) having the center axis of the coating roller 14 positioned below the upper surface of the conveyor means 7 and a second position (II) having the peripheral surface of the coating roller 14 positioned above the upper surface of the conveyor means 7 as best seen from FIGS. 3*a*, 3*b*, 3*c* and 3*d*.

On the floor 2 between the first and second frame structures 1 and 4 is installed an electric motor 18 which has an output shaft securely carrying a sprocket wheel 19 thereon. The sprocket wheel 19 is assembled with an endless chain 20 which is passed over a sprocket wheel 21 securely carried on the rear shaft 11. The sprocket wheel 21 is in turn secured to a sprocket wheel 22 which is drivably connected to a sprocket wheel 24 by means of an endless chain 23. The coating roller 14 is thus caused to rotate by means of the electric motor 18 through the sprocket wheel 19, the endless chain 20, the sprocket wheels 21, 22, the endless chain 23 and the sprocket wheel 24 in a direction indicated by an arrow B in FIG. 1. The electric motor 18, the sprocket wheels 19, 21, 22 and 24, and the endless chains 20 and 23 constitute as a whole drive means for driving the coating roller 14 to rotate.

A pair of arm plates 26 and 27 have at their rear end portions boss portions 26*a* and 27*a* which are securely connected to the longitudinally intermediate portion of the front shaft 10 and at their front end portions carried thereon a press member 28 which is adapted to press the leading beveled end portion of the rubber strip material 6 against the peripheral surface of the coating roller 14. The front shaft 10 has an extention portion 10*a* axially projecting outwardly from the bearing 12 secured to the bracket member 8 and securely carrying one end portion of a rockable arm 30. The rockable arm 30 has the other end portion pivotally connected through a pivot pin 31 to the leading end portion of a piston rod 32 forming part of a fluid cylinder 33. The fluid cylinder 33 has a cylinder body 33*a* which has its rear end portion pivotally connected to a bracket member 34 secured to the outer surface of the upstanding post member 8 projecting upwardly from the first structure 1. The fluid cylinder 33 includes upper and lower chambers which are partitioned by a piston slidably received in the cylinder body 33*a* of the fluid cylinder 33 and which are held in communication with a suitable fluid source through a change-over valve not shown. The change-over valve is adapted to be changed by previously mentioned control means in such a manner as to allow high pressure fluid to selectively be introduced into the upper and lower chambers of the fluid cylinder 33. A pair of fluid cylinders 35 and 36 have their cylinder bodies 35*a* and 36*a* having at their rear end portions boss portions 37 and 38, respectively, which are securely connected to the longitudinally intermediate portions of the front shaft 10 axially outwardly of the boss portions 26*a* and 27*a* of the arm plates 26 and 27, and extend toward the coating roller 14. The fluid cylinders 35 and 36 further have respective piston rods 35*b* and 36*b* respectively carrying thereon side press members 39 and 40 which extend in parallel with the center axis of the coating roller 14 and axially outwardly of the press member 28. Each of the fluid cylinders 35 and 36 includes front and rear chambers which are partitioned by a piston slidably received in the cylinder bodies 35*a* and 36*a* of each of the fluid cylinders 35 and 36 and which are held in communication with a suitable fluid source through a change-over valve not shown. The change-over valve is adapted to be changed by the previously mentioned control means in such a manner as to allow high pressure fluid to selectively be introduced into the front and rear chambers of each of the fluid cylinders 35 and 36. When the fluid cylinder 33 is actuated to cause its piston rod 32 to project upwardly and downwardly by means of the control means, the rockable arm 30 is rocked about the front shaft 10. The arm plates 26, 27 and the fluid cylinders 35 and 36 are thus rockable about the front shaft 10 so that the press member 28 and the side press members 39 and 40 are simultaneously caused to move toward and away from the coating roller 14.

The adhesive compound coating apparatus embodying the present invention further comprises a beam plate 41 extending axially between the first and second frame structures 1 and 4 and has opposite ends fixedly coupled to the structures 1 and 4. The beam plate 41 in turn has securely mounted thereon an adhesive compound receptacle 42 for reserving an adhesive compound therein. An adhesive compound supplying roller 43 is housed in the receptacle 42 and has a shaft rotatably supported on the side wall portions of the receptacle 42 with its upper peripheral surface portion surfaced from the upper plane of the receptacle 42 so as to be capable of being brought into rolling contact with the coating roller 14. The adhesive compound receptacle 42 is supplied and circulated with the adhesive compound of a predetermined concentration from an pump not shown in the drawings so as to have the supplying roller 43 partially at all times placed in the adhesive compound in the receptacle 42. The shaft of the suppling roller 43 has an extension portion projecting outwardly from the side wall portion of the receptacle 42 and securely carrying thereon a sprocket wheel 44. The sprocket wheel 44 is driven to rotate by the endless chain 20 passed around the sprocket wheels 19 and 21 so that the supplying roller 43 is caused to rotate in the receptacle 42 by the electric motor 18 in a direction indicated by an arrow C in FIG. 1. An idler sprocket wheel 49 is rotatably mounted on the beam plate 41 and have the endless chain 20 passed thereon to impart an adequate tension to the endless chain 20. The receptacle 42 and the adhesive compound supplying roller 43 constitute as a whole adhesive supplying means 45 for supplying and applying the adhesive compound on the peripheral surface of the coating roller 14.

The adhesive compound coating apparatus embodying the present invention further comprises detecting means 46 which is operative to detect the positions of the leading and trailing beveled end faces of the rubber strip material 6 conveyed by the conveyor means 7 and to produce output signals to be delivered to the control means. The detecting means 46 comprises a light projector 47 and a light receiver 48 which are positioned across the guide roller 3 and securely mounted on the first frame structure 1.

Operation of the adhesive compound coating apparatus thus constructed and arranged will now be described hereinafter.

Figure 3:
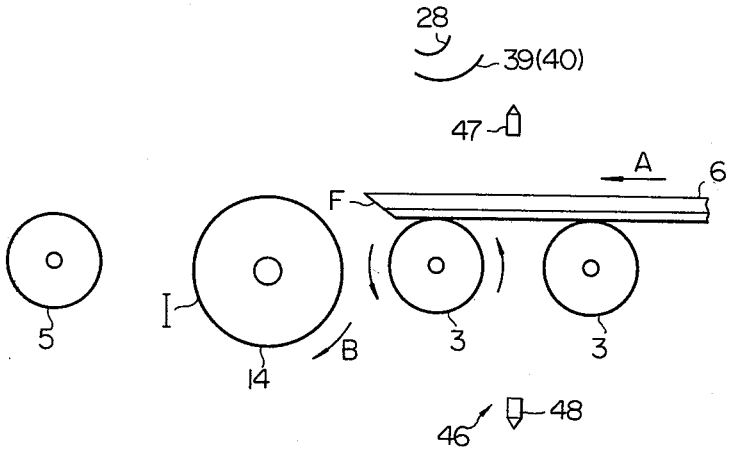
FIGS. 3*a* to 3*d* are schematic views showing the steps of coating an adhesive compound on the leading and trailing beveled end faces of a rubber strip material by means of the adhesive compound coating apparatus according to the present invention.
Figure 3:
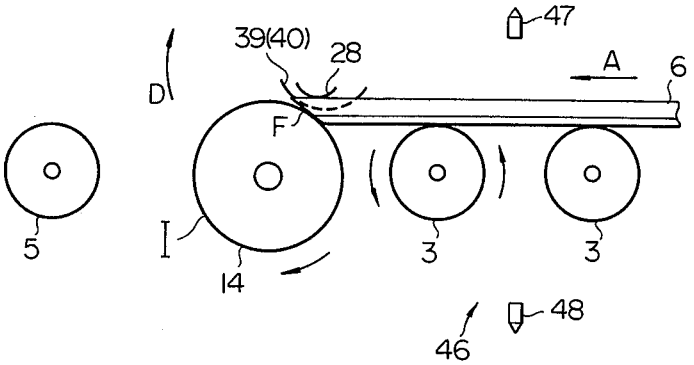

In the preliminary stage of the operation of the adhesive compound coating apparatus, the electric motor of the conveyor means 7, the pump of the adhesive compound supplying means 45, and the electric motor 18 are driven to rotate. The guide rollers 3 and 5 are thus caused to rotate, and the coating roller 14 and the supplying roller 43 are simultaneously caused to rotate in the respective directions indicated by the arrows B and C, respectively. Simultaneously with the rotations of the guide rollers 3 and 5 and the coating roller 14 and the supplying roller 43, the adhesive compound is circulated and supplied to the receptacle 42 by the pump of the adhesive compound supplying means 45. On the other hand, the fluid cylinder 17 is supplied with high pressure fluid to forwardly project the piston rod 17*a* until the coating roller 14 is moved to the first position where the center axis of the coating roller 14 is positioned below the upper surfaces of the rollers 3 and 5 of the conveyor means 7 to the degree that upper peripheral surface of the coating roller 14 is positioned to project slightly over the upper surfaces of the guide rollers 3 and 5. On the other hand, the upper chamber of the fluid cylinder 33 and the front chambers of the fluid cylinders 35 and 36 are at this time supplied with the high pressure fluid, with the result that the piston rod 32 of the fluid cylinder 33 is retracted downwardly to cause the arm plates 26, 27 and the fluid cylinders 35 and 36 to upwardly rock about the front shaft 10 through the rockable arm 30. The press member 28 and the side press members 39 and 40 are upwardly moved to assume respective upper positions where the press member 28 and the side press members 39 and 40 are remotest from the coating roller 14 as shown in FIG. 3*a*.

Figure 3C:
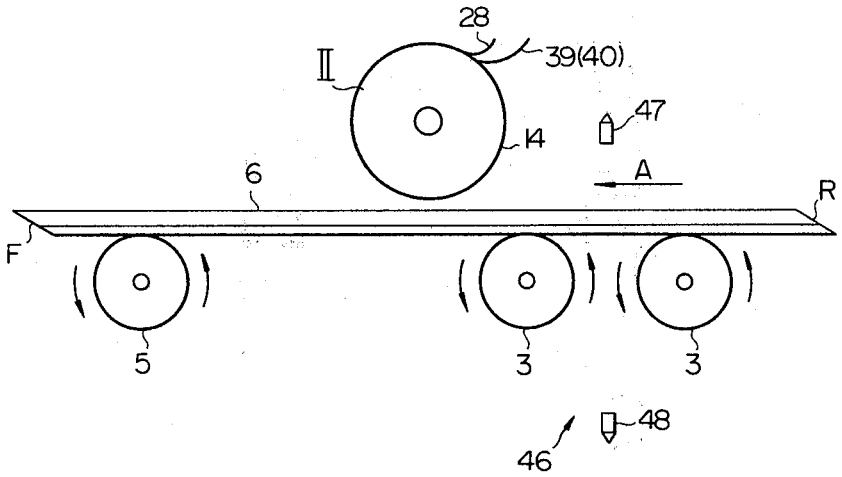
Figure 3D:
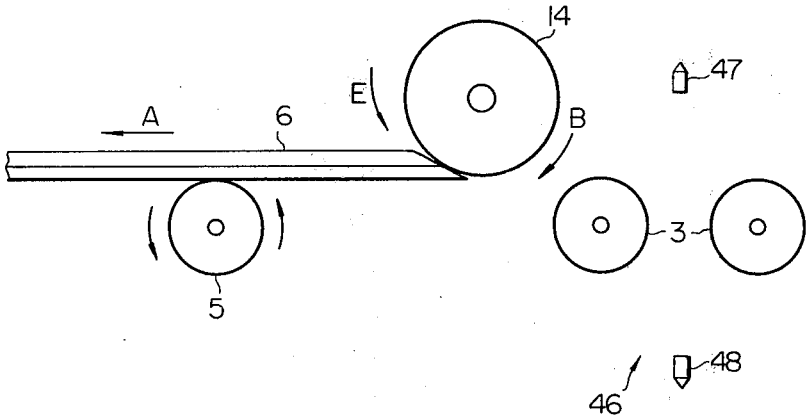

Under these conditions, the rubber strip material 6 is bias-cut at its leading and trailing end portions by a suitable cutter provided upstream of the conveyor means 7. The leading and trailing end portions of the rubber strip material 6 are thus inclined with respect to the upper and lower surfaces thereof and in parallel with each other. The rubber strip material 6 thus having leading and trailing beveled end faces is conveyed on and by the guide rollers 3 of the conveyor means 7 in the direction indicated by the arrow A with its leading end face F directed downwardly and forwardly and its trailing end face R directed upwardly and backwardly. When the rubber strip material 6 intercepts the light beam projected from the light projector 47 to the light receiver 48, the detecting means 46 is operated to deliver an electric signal to the control means where time starts to be counted until the leading end F of the rubber strip material 6 reaches the outer peripheral surface of the coating roller 14. When the leading end F of the rubber strip material 6 reaches and is brought into surface-surface contact with the outer peripheral surface of the coating roller 14, the control means is operated to produce an electric signal to cause the change-over valve for the fluid cylinders 33, 35 and 36 to be changed so as to supply high pressure fluid to the lower chamber of the fluid cylinder 33 and the rear chambers of the fluid cylinders 35 and 36. As a consequence, the press member 28 and the side press members 39 and 40 are caused to moved to the upper peripheral surface of the coating roller 14 so that the leading end face F is pressurized into surface-surface contact with the outer peripheral surface of the coating roller 14. For the reason that the receptacle 42 is being supplied with the adhesive compound by the pump and the coating roller 14 is being rotated and supplied with the adhesive compound by the adhesive compound supplying roller 43, the leading end face F of the rubber strip material 6 is reliably coated with the adhesive compound having a rubber constant concentration. The coating of the adhesive compound on the coating roller 14 results in the fact that the outer peripheral surface of the coating roller 14 is prevented from being contaminated. After the leading end face F has been coated with the adhesive compound, the control means is operated to produce electric signals to cause the change-over valve for the fluid cylinders 17, 33, 35 and 36 to supply high pressure fluid to the front chamber of the fluid cylinder 17, the upper chamber of the fluid cylinder 33 and the front chambers of the fluid cylinders 35 and 36. As a consequence, the press member 28 and the side press members 39 and 40 are caused to moved away from the upper peripheral surface of the coating roller 14 to their initial respective positions, and the coating roller 14 is simultaneously moved to the second position (II) where the coating roller 14 is positioned above the guide rollers 3 of the conveyor means 7 as shown in FIG. 3*c*. The rubber strip material 6 is then moved and transferred from the guide rollers 3 on the first frame structure 1 to the guide rollers 5 on the second frame structure 4 as shown in FIG. 3*c*. When a predetermined lapse of time is counted, viz., when the trailing end face R of the rubber strip material 6 is conveyed to a predetermined position immediately below the coating roller 14 after the coating roller 14 is moved to the second postion (II), the control means is operated to produce the electric signals to cause the change-over valve for the fluid cylinder 17 to supply high pressure fluid to the rear chamber of the fluid cylinder 17. As a consequence, the coating roller 14 is downwardly moved in a direction indicated by arrow E in FIG. 3*d* toward the first position (I). During downward movement of the coating roller 14 toward its first position (I), the trailing end R of the rubber strip material 6 is pressurized by and is forced into surface-to-surface contact with the coating roller 14, with the result that the trailing end face R of the rubber strip material 6 is reliably coated with the adhesive compound by the coating roller 14 in a similar fashion. Finally, the coating roller 14 is returned to the first position (I).

The control means according to the present invention as described hereinbefore is responsive to the output signals delivered from the detecting means 46 and operative to move the coating roller 14 toward the second position (II) from the first position (I) when the leading beveled end face F of the rubber strip material 6 is advanced to the coating roller 14 so that the leading beveled end face F of the rubber strip material 6 is brought into contact with the peripheral surface of the coating roller 14 and is coated with the adhesive compound by the coating roller 14, and operative to move the coating roller 14 toward the first position (I) from the second position (II) when the trailing beveled end face R of the rubber strip material 6 is conveyed to a predetermined positioned so that the trailing beveled end face R of the rubber strip material 6 is brought into contact with the peripheral surface of the coating roller 14 and is coated with the adhesive compound by the coating roller 14.

While there has been described one cycle of operation of coating the adhesive compound on the leading and trailing end faces F and R of the rubber strip material 6 by means of the adhesive compound coating apparatus, such cycles of operation of the apparatus are repeated for coating the leading and trailing end faces F and R of a number of rubber strip materials.

What is claimed is:

1. An adhesive compound coating apparatus for coating an adhesive compound on leading and trailing beveled end faces of a rubber strip material, the leading and trailing beveled end faces being bias-cut in parallel with each other with respect to the upper and lower surfaces of the rubber strip material, comprising:

conveyor means for conveying the rubber strip material in its longitudinal direction;

a coating roller disposed to have a center axis substantially perpendicular to the longitudinal direction of said rubber strip material and rotatable about its center axis, the coating roller being movable with respect to said conveyor means between a first position having the center axis of the coating roller positioned below the upper surface of said conveyor means and a second position having the peripheral surface of the coating roller positioned above the upper surface of said conveyor means;

drive means for driving the coating roller to rotate about its center axis;

adhesive compound supplying means for supplying and applying the adhesive compound on the peripheral surface of said coating roller;

detecting means operative to detect the positions of the rubber strip material conveyed by said conveyor means and produce output signals; and control means responsive to the output signals delivered from said detecting means and operative to move said coating roller toward said second position from said first position when the leading beveled end face of the rubber strip material is advanced to said coating roller so that the leading beveled end face of the rubber strip material is brought into contact with the peripheral surface of said coating roller and is coated with the adhesive compound by said coating roller, and operative to move the coating roller toward said first position from said second position when the trailing beveled end face of the rubber strip material is advanced to said coating roller so that the trailing beveled end face of the rubber strip material is brought into contact with the peripheral surface of said coating roller and is coated with the adhesive compound by said coating roller.

2. An adhesive compound coating apparatus as set forth in claim 1, further comprising a press member and side press members, the press member and the side press members being movable toward and away from the upper peripheral surface of said coating roller so that said leading beveled end face of said rubber strip material is pressurized into surface-surface contact with the outer peripheral surface of said coating roller.

3. An adhesive compound coating apparatus as set forth in claim 1, in which the outer peripheral surface of said coating roller is constructed of a cellular sponge capable of absorbing an adhesive compound.

4. An adhesive compound coating apparatus as set forth in claim 1, in which said detecting means is constituted by a light projector and a light receiver which are positioned across a first guide roller of a first frame structure and securely mounted on said first frame structure.

* * * * *